US009127439B2

(12) United States Patent
Ooi et al.

(10) Patent No.: US 9,127,439 B2
(45) Date of Patent: Sep. 8, 2015

(54) ENGINE CONTROL DEVICE

(75) Inventors: Takeshi Ooi, Kanagawa (JP); Masashi Ichihara, Kanagawa (JP); Teruo Akiyama, Tokyo (JP); Hisashi Asada, Kanagawa (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 481 days.

(21) Appl. No.: 13/577,217

(22) PCT Filed: Feb. 1, 2011

(86) PCT No.: PCT/JP2011/051997

§ 371 (c)(1),
(2), (4) Date: Aug. 3, 2012

(87) PCT Pub. No.: WO2011/096383

PCT Pub. Date: Aug. 11, 2011

(65) Prior Publication Data

US 2012/0304635 A1 Dec. 6, 2012

(30) Foreign Application Priority Data

Feb. 3, 2010 (JP) ..... 2010-022299
Mar. 17, 2010 (JP) ..... 2010-060768

(51) Int. Cl.

| | |
|---|---|
| ***F02D 29/04*** | (2006.01) |
| ***E02F 9/22*** | (2006.01) |
| ***F02D 41/02*** | (2006.01) |
| ***F02D 31/00*** | (2006.01) |

(52) U.S. Cl.

CPC ..... *E02F 9/2246* (2013.01); *E02F 9/2296* (2013.01); *F02D 29/04* (2013.01); *F02D 31/007* (2013.01); *F02D 41/021* (2013.01); *F02D 41/0205* (2013.01); *F02D 2250/18* (2013.01)

(58) Field of Classification Search

CPC ..... E02F 9/2246
USPC ..... 60/431
See application file for complete search history.

(56) References Cited

U.S. PATENT DOCUMENTS 7,543,448 B2 * 6/2009 Nakamura et al. ..... 60/434
7,584,611 B2 * 9/2009 Ariga et al. ..... 60/431

(Continued)

FOREIGN PATENT DOCUMENTS

JP 10273919 A 10/1998
JP 2002266671 A 9/2002

(Continued)

OTHER PUBLICATIONS

International Search Report issued in International Application No. PCT/JP2011/051997 dated Apr. 12, 2011, 3 pages (including English Translation).

*Primary Examiner* — Nathaniel Wiehe
*Assistant Examiner* — Dustin T Nguyen
(74) *Attorney, Agent, or Firm* — Fish & Richardson P.C.

(57) ABSTRACT

A first target engine speed is set in response to a command value commanded by a command unit. A second target engine speed equal to or lower than the first target engine speed is set based on the first target engine speed. When the first target engine speed is reduced, the second target engine speed is set to be constant or be decreased and a reduction range for decreasing the first target engine speed to the second target engine speed is set to be decreased. The reduction range is set at zero when the first target engine speed is equal to or lower than an engine speed at least at a maximum torque point.

8 Claims, 13 Drawing Sheets

(56) References Cited

U.S. PATENT DOCUMENTS

| | | | | |
|---|---|---|---|---|
| 8,640,451 | B2 * | 2/2014 | Akiyama et al. | 60/434 |
| 2002/0126570 | A1 | 9/2002 | Kamoshida et al. | |
| 2010/0332102 | A1 | 12/2010 | Akiyama et al. | |

FOREIGN PATENT DOCUMENTS

| | | | | |
|---|---|---|---|---|
| JP | WO2008/087847 | * | 7/2008 | F15B 2211/253 |
| JP | 2008180203 | A | 8/2008 | |
| WO | 2009104636 | A1 | 8/2009 | |

* cited by examiner

ENGINE CONTROL DEVICE

CROSS-REFERENCE TO RELATED APPLICATIONS

This application claims priority to Application No. PCT/JP2011/051997 filed Feb. 1, 2011, which application claims priority to Japanese Application Nos. 2010-022299, filed on Feb. 3, 2010 and 2010-060768, filed on Mar. 17, 2010. The contents of the above applications are incorporated herein by reference in their entireties.

TECHNICAL FIELD

The present invention relates to an engine control device that controls drive of an engine based on a set target engine speed, more specifically, an engine control device with an enhanced fuel consumption of the engine.

BACKGROUND ART

In a construction machine, when a pump absorption torque is equal to or lower than a rated engine torque, an engine output torque is matched to the pump absorption torque in a high-speed control area on an engine-output-torque-characteristics line showing a relationship between an engine speed and the engine output torque. For instance, the target engine speed is set corresponding to the setting of a fuel dial and a high-speed control area is determined corresponding to this target engine speed.

Alternatively, the high-speed control area is set corresponding to the setting of the fuel dial and the target engine speed is set corresponding to this high-speed control area. The pump absorption torque and the engine output torque are controlled for matching in this high-speed control area.

Many operators generally set a target engine speed at or around a rated engine speed so as to improve a workload. A low engine-fuel-consumption area (i.e., an engine-fuel-efficient area) usually exists in a middle-speed area and a high-torque area on the engine-output-torque-characteristics line. Accordingly, a high-speed control area defined between a non-load high-idle speed and the rated engine speed does not correspond to an efficient area in terms of fuel consumption.

In order to drive an engine in the fuel-efficient area, a typically known control device presets a value of a target engine speed and a value of a target engine output torque such that the values correspond to each other, for each of plural selectable operation modes (see, for instance, Patent Literature 1). With the use of such a control device, when an operator selects, for instance, a second operation mode, the engine speed can be set lower than that in a first operation mode, and therefore the fuel consumption can be improved.

However, according to the above-described operation mode switching, the operator needs to operate the operation mode switching each time so as to improve the fuel consumption. Further, in a situation where the engine speed in the second operation mode is set at a value simply reduced relative to the engine speed in the first operation mode, selection of the second operation mode leads to the following problem.

The maximum speed of a working device of a construction machine (hereinafter referred to as a working equipment) is decreased as compared to that in the first operation mode. As a result, a workload in the second operation mode becomes smaller than that in the first operation mode.

In order to solve this problem, the applicant has already filed a patent application directed to an engine control device and an engine control method (see Patent Literature 2).

According to the above engine control device, when a pump capacity and an engine output torque are low, the drive control of engine is conducted based on the second target engine speed that is closer to a low-speed area than the preset first target engine speed, thereby reaching the preset target engine speed corresponding to the pump capacity of a variable displacement hydraulic pump driven by the engine or the detected engine output torque.

According to the above engine control device, the fuel consumption of the engine is improvable and the engine speed is excellently smoothly changeable while a pump discharge amount required for the working equipment is maintained. Furthermore, an uncomfortable feeling resulting from a discontinuous change in engine noise can be prevented.

CITATION LIST

Patent Literature(s)

Patent Literature 1: JP-A-10-273919

Patent Literature 2: International Publication No. WO2009/104636

SUMMARY OF THE INVENTION

Problem to be Solved by the Invention

In the invention of the engine control device described above in Patent Literature 2, the drive control of the engine is started based on the second target engine speed lower than the first target engine speed, instead of the first target engine speed instructed using a fuel command dial or the like. However, it is not disclosed in the invention of Patent Literature 2 how to set the second target engine speed according to the first target engine speed when the first target engine speed is reduced from the rated engine speed.

The second target engine speed is lower than the first target engine speed. The lower second target engine speed is set, the larger fuel-saving effects can be provided.

However, when the first target engine speed is reduced from the rated engine speed, if a reduction range from the first target engine speed to the second target engine speed is fixed, a pump flow volume may become insufficient. This is because the pump flow volume near the maximum torque point on the engine-output-torque-characteristics line is restrained by a pump-absorption-torque-limit line that is set to prevent an engine stall.

An object of the invention is to improve the invention of Patent Literature 2 described above in the aforementioned situation not disclosed in the invention of Patent Literature 2. More specifically, an object of the invention is to provide an engine control device capable of controlling an engine more fuel-efficiently and obtaining an absorption torque required in a hydraulic pump.

Means for Solving the Problems

The problem of the invention can be suitably solved by the following aspects of the invention on an engine control device.

According to a first aspect of the invention, an engine control device includes: a variable displacement hydraulic pump driven by an engine; a hydraulic actuator driven by a discharge pressure oil from the hydraulic pump; a control valve that controls the discharge pressure oil from the hydraulic pump so that the discharge pressure oil is supplied to the hydraulic actuator; a detector that detects a pump capacity of the hydraulic pump; a fuel injector that controls a fuel supplied to the engine; a command unit that selects a command value among variable command values and commands the command value; a first setting unit that sets a first target engine speed in response to the command value commanded by the command unit and a second target engine speed based on the first target engine speed, the second target engine speed being equal to or lower than the first target engine speed; a second setting unit that sets a target engine speed according to the pump capacity, the target engine speed having the second target engine speed as a lower limit; and a controller that controls the fuel injector so as to provide the target engine speed set by the second setting unit, in which the first setting unit is configured to keep the second target engine speed constant or decrease the second target engine speed and to decrease a reduction range for decreasing the first target engine speed to the second target engine speed when the first target engine speed is reduced, and the reduction range is set at zero when the first target engine speed is equal to or lower than an engine speed at a maximum torque point.

According to a second aspect of the invention, the first setting unit is configured to decrease the second target engine speed when the first target engine speed is reduced in a predetermined range.

According to a third aspect of the invention, the first setting unit sets the second target engine speed at a predetermined engine speed when the first target engine speed is set at the engine speed that is equal to or exceeds the engine speed at which a pump-absorption-torque-characteristic line in the hydraulic pump starts to shift when the first target engine speed is decreased from a rated engine speed.

According to a fourth aspect of the invention, the engine control device further includes a detector that detects an engine output torque, in which the second setting unit sets the target engine speed according to the pump capacity or the engine output torque, the target engine speed having the second target engine speed as the lower limit.

Advantages of the Invention

In the engine control device of the invention, the second target engine speed can be set according to the set first target engine speed. When the first target engine speed is set low, the second target engine speed can be set low according to the set first target engine speed, so that fuel consumption can be reduced.

Moreover, the reduction range for setting the second target engine speed can be decreased according to the first target engine speed.

In other words, the reduction range by which the first target engine speed is decreased to the second target engine speed is configured to be decreased as the first target engine speed becomes lower.

With this arrangement, as the first target engine speed is decreased in response to a command by the command unit, a difference between the second target engine speed and the first target engine speed becomes small to make it difficult to limit a pump discharge flow volume by the pump-absorption-torque-limit line.

When the first target engine speed is decreased to an engine speed that is equal to or lower than the engine speed at the maximum torque point, the second target engine speed is set to be equal to the decreased first target engine speed. With this arrangement, since the engine control is started based on the second target engine speed that is equal to the first target engine speed, a pump absorption torque equal to that obtained by controlling at the first target engine speed is obtainable from the engine output torque in the hydraulic pump.

When the second engine speed is set to be decreased as the first target engine speed is decreased according to the second aspect of the invention, an operator does not feel discomfort caused by a situation where the second target engine speed fails to be decreased although the first target engine speed is decreased by the fuel dial.

According to the third aspect of the invention, when the first target engine speed is set at the engine speed that is equal to or exceeds the engine speed at which the pump-absorption-torque-characteristics line in the hydraulic pump starts to shift when the first target engine speed is decreased from the rated engine speed, the second target engine speed can be set at the predetermined engine speed.

Even with this arrangement, a relationship between the pump-absorption-torque-limit line and the high-speed control area according to the second target engine speed is unchanged. Accordingly, the pump absorption torque required in the hydraulic pump can be secured. With regard to operability of the hydraulic actuator expected by the operator who sets the first target engine speed, the operator does not feel discomfort about operability. Moreover, since the second target engine speed can be kept low even though the first target engine speed is increased, the fuel efficiency can be significantly improved.

With the arrangement according to the fourth aspect of the invention, the hydraulic actuator is smoothly operable at a high efficiency while the operation of the hydraulic actuator is not adversely affected.

DESCRIPTION OF EMBODIMENT(S)

An exemplary embodiment of the invention will be specifically described below with reference to the attached drawings. An engine control device according to the invention can be favorably employed as a control device for controlling an engine installed in a construction machine such as a hydraulic excavator, a bulldozer and a wheel loader.

Moreover, the engine control device according to the invention may be shaped or configured in any manner other than those described below as long as they serve to attain an object of the invention. Accordingly, the invention is not limited to the exemplary embodiment described below but various modifications or changes can be made thereto.

EXAMPLE(S)

Figure 1:
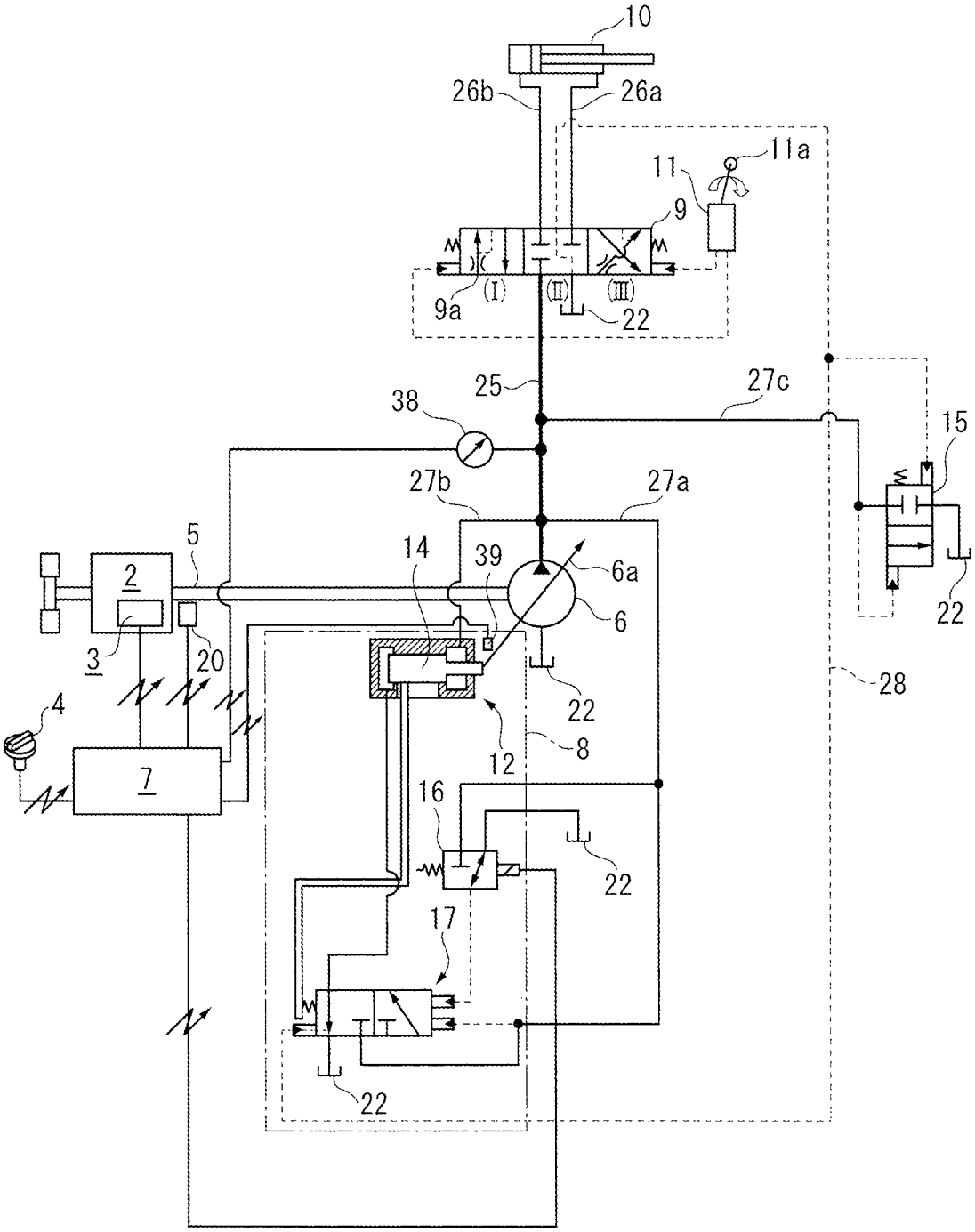
FIG. 1 is a hydraulic circuit diagram according to an exemplary embodiment of the invention.

FIG. 1 is a hydraulic circuit diagram of an engine control device according to the exemplary embodiment of the invention. An engine 2 is a diesel engine. An engine output torque of the engine 2 is controlled by adjusting a fuel amount ejected into a cylinder of the engine 2. A typically known fuel injection device 3 can adjust the fuel amount.

An output shaft 5 of the engine 2 is connected to a variable displacement hydraulic pump 6 (hereinafter referred to as a hydraulic pump 6), so that the rotation of the output shaft 5 drives the hydraulic pump 6. The inclination angle of a swash plate 6*a* of the hydraulic pump 6 is controlled by a pump control device 8. A change in the inclination angle of the swash plate 6*a* leads to a change in a pump capacity D (cc/rev) of the hydraulic pump 6.

The pump control device 8 includes: a servo cylinder 12 that controls the inclination angle of the swash plate 6*a*; and an LS valve (Load Sensing valve) 17 that is controlled in response to a differential pressure between a pump pressure and a load pressure of a hydraulic actuator 10. The servo cylinder 12 includes a servo piston 14 that acts on the swash plate 6*a*. A discharge pressure from the hydraulic pump 6 is supplied through oil paths 27*a* and 27*b*. The LS valve 17 is activated in response to a differential pressure between a hydraulic pressure (a pump discharge pressure) of the oil path 27*a* and a hydraulic pressure (the load pressure of the hydraulic actuator 10) of a pilot oil path 28, thereby controlling the servo piston 14.

The inclination angle of the swash plate 6*a* of the hydraulic pump 6 is controlled by the servo piston 14. Moreover, a control valve 9 is controlled by a pilot pressure outputted from an operation lever device 11 in response to the operation amount of an operation lever 11*a*, thereby controlling the flow volume supplied to the hydraulic actuator 10. The pump control device 8 is provided by a known load sensing control device.

A pilot pressure through a solenoid proportional valve 16 from an oil path branched from the oil path 27*a* is supplied to an end of the LS valve 17 to which an oil pressure (a pump discharge pressure) of the oil path 27*a* is supplied. The solenoid proportional valve 16 is configured to adjust the pilot pressure supplied to the end of the LS valve 17 by the command value from the controller 7. The controller 7 can limit an angle (corresponding to the pump capacity) of the swash plate 6*a* of the hydraulic pump 6 by limiting the command value of the solenoid proportional valve 16.

Accordingly, the controller 7 can limit the pump absorption torque according to the engine speed detected by the engine speed sensor 20 by setting a pump-absorption-torque-limit line described later. It should be noted that a unit for limiting the pump absorption torque can be provided by a unit other than the aforementioned unit. A conventionally known torque control valve may be separately provided as the unit for limiting the pump absorption torque.

A pressure oil discharged from the hydraulic pump 6 is supplied to the control valve 9 through an oil discharge path 25. The control valve 9 is configured as a five-port three position switching valve. The pressure oil discharged from the control valve 9 is selectively supplied to the oil paths 26*a* or 26*b*, thereby actuating the hydraulic actuator 10.

It is not to be understood that the hydraulic actuator is limited to the above-exemplified cylinder hydraulic actuator. The hydraulic actuator may be provided by a hydraulic motor or a rotary hydraulic actuator. Though only one pair of the control valve 9 and the hydraulic actuator 10 is exemplified above, plural pairs of the control valves 9 and the hydraulic actuators 10 may be provided, or plural actuators may be operated by a single control valve.

When a hydraulic excavator in a form of a construction machine, for instance, is taken as an example for illustrating the hydraulic actuator, the hydraulic actuator is employed for each of a boom hydraulic cylinder, an arm hydraulic cylinder, a bucket hydraulic cylinder, a left-travel hydraulic motor, a right-travel hydraulic motor, a turning motor and the like. FIG. 1 shows the boom hydraulic cylinder as a representative example of these hydraulic actuators.

When the operation lever 11*a* is moved from a neutral position, a pilot pressure is outputted from the operation lever device 11 according to the operation direction and the operation amount of the operation lever 11*a*. The outputted pilot pressure is applied to either a left pilot port or a right pilot port of the control valve 9. In this manner, the control valve 9 is switched from a (II) position (neutral position) to either one of left and right positions, namely a (I) position and a (III) position.

When the control valve 9 is switched from the (II) position to the (I) position, the discharge pressure oil from the hydraulic pump 6 is supplied to the bottom side of the hydraulic actuator 10 through the oil path 26*b*, whereby a piston of the hydraulic actuator 10 is expanded. At this time, the pressure oil at the head side of the hydraulic actuator 10 is discharged into a tank 22 from the oil path 26*a* via the control valve 9.

Likewise, when the control valve 9 is switched to the (III) position, the discharge pressure oil from the hydraulic pump 6 is supplied to the head side of the hydraulic actuator 10 through the oil path 26*b*, whereby the piston of the hydraulic actuator 10 is retracted. At this time, the pressure oil at the bottom side of the hydraulic actuator 10 is discharged into the tank 22 from the oil path 26*b* via the control valve 9.

Herein, the head side of the hydraulic actuator 10 means a hydraulic chamber near a rod of the hydraulic cylinder. The bottom side of the hydraulic actuator 10 means a hydraulic chamber at the opposite side of the rod of the hydraulic cylinder.

An oil path 27*c* is branched from the middle of the oil discharge path 25. An unload valve 15 is disposed in the oil path 27*c*. The unload valve 15 is connected to the tank 22. The unload valve 15 is switchable between a position where the oil path 27*c* is cut off and a position where the oil path 27*c* is in communication. The oil pressure in the oil path 27*c* acts as a pressing force for switching the unload valve 15 to the communication position.

Moreover, a pilot pressure in the pilot oil path 28 where the load pressure of the hydraulic actuator 10 acts and a pressing force of the spring act as a pressing force for switching the unload valve 15 to the cut-off position. Hence, the unload valve 15 is controlled based on a differential pressure between the combination of the pilot pressure in the pilot oil path 28 and the pressing force of the spring and the oil pressure in the oil path 27*c*.

A controller 7 can be provided by, for instance, a computer including a storage that is used as a program memory and a work memory and a CPU that executes a program. The storage of the controller 7 stores Tables 1 to 3 of FIGS. 10A to 10C, a relationship shown in FIG. 12, a relationship shown in FIG. 13, and the like.

Figure 2:
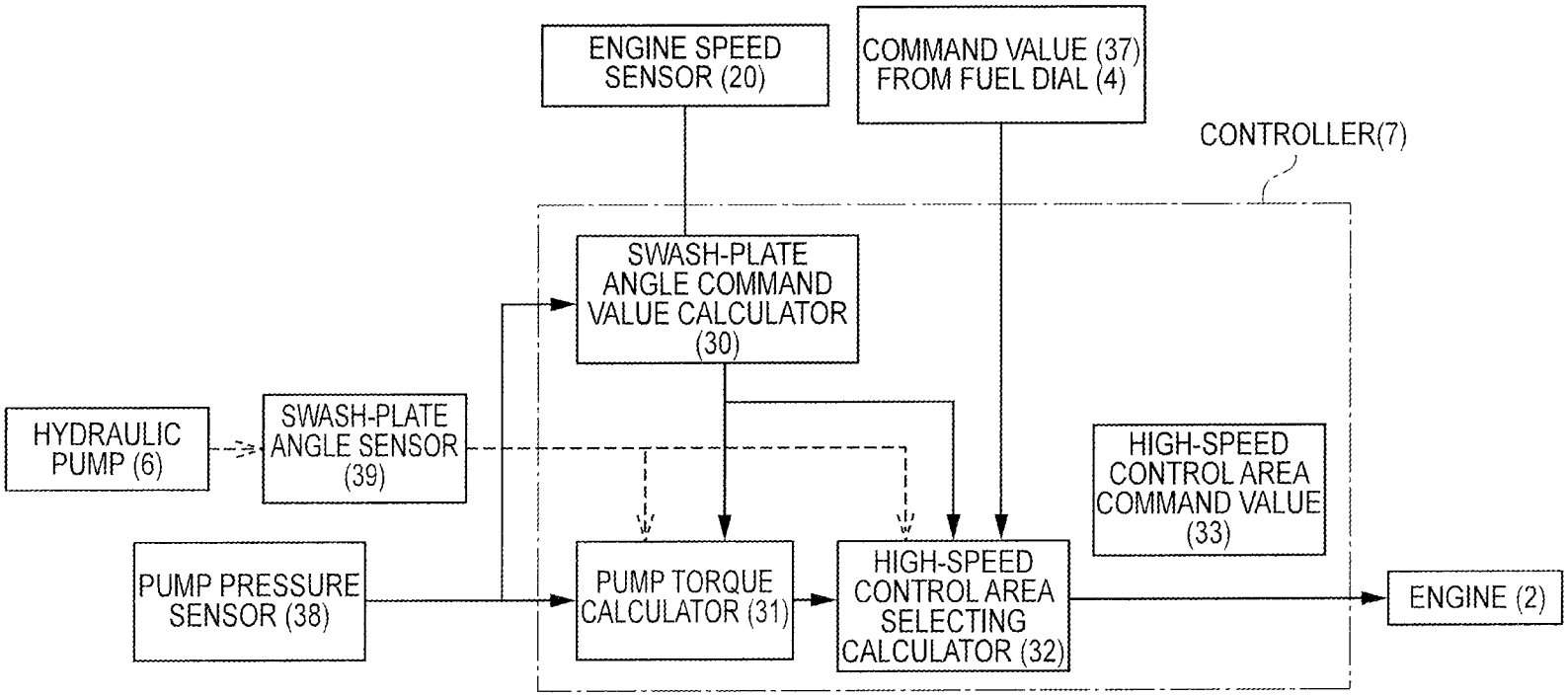
FIG. 2 is a block diagram of a controller.

Next, the control of the controller 7 will be described with reference to the block diagram of FIG. 2. In FIG. 2, a high-speed control area selecting calculator 32 in the controller 7 receives not only a command value 37 of the fuel dial 4 but also a command value of the pump torque required for the hydraulic pump 6 which is calculated by a pump torque calculator 31, and a pump capacity corresponding to a swash-plate angle of the hydraulic pump 6.

The pump torque calculator 31 receives a pump pressure discharged from the hydraulic pump 6 which is detected by a pump pressure sensor 38 and the swash-plate angle of the hydraulic pump 6 which is calculated by a swash-plate angle command value calculator 30 that commands the swash-plate angle of the hydraulic pump 6. The pump torque calculator 31 calculates a command value of a pump torque (a command value of the engine output torque) required in the hydraulic pump 6 from the inputted swash-plate angle and pump pressure of the hydraulic pump 6.

Specifically, in general, a relationship in the hydraulic pump 6 between the pump discharge pressure P (pump pressure P), the discharge capacity D (pump capacity D), and the engine output torque T is expressed by an equation of $T=P\cdot D/200\pi$.

According to the equation, the swash-plate angle command value calculator 30 can calculate the engine output torque (the pump torque) by detecting a rotation speed of the hydraulic pump 6 driven by the engine 2 as the engine speed and detecting the pump pressure (i.e., the discharge pressure) from the hydraulic pump 6 by the pump pressure sensor 38.

The command value of the pump torque (the command value of the engine output torque) required in the hydraulic pump 6 which is calculated by the pump torque calculator 31 can be calculated using a detection value of the pump pressure and the detection value of the swash-plate angle sensor 39 instead of using the detection value of the pump pressure and the command value calculated by the swash-plate angle command value calculator 30.

A calculation in the pump torque calculator 31 using the detection value of the pump pressure and the detection value of the swash-plate angle sensor 39 is illustrated with dotted lines in FIG. 2.

The swash-plate angle command value calculator 30 can calculate using the pump pressure P detected by the pump pressure sensor 38 and the detection value from the engine speed sensor 20. The calculation results by the swash-plate angle command value calculator 30 are inputted to the pump torque calculator 31. In other words, based on the pump pressure P and the rotation speed of the hydraulic pump 6, the pump capacity D of the hydraulic pump 6 at that time can be calculated, thereby calculating a pump swash-plate angle corresponding to the pump capacity D.

The high-speed control area selecting calculator 32 commands a high-speed control area command value 33 to the engine 2 for drive control thereof.

The pump pressure sensor 38 can be disposed, for instance, for detecting the pump pressure in the oil discharge path 25 of FIG. 1. The swash-plate angle sensor 39 can be configured to function as a sensor detecting the swash-plate angle of the hydraulic pump 6.

Figure 3:
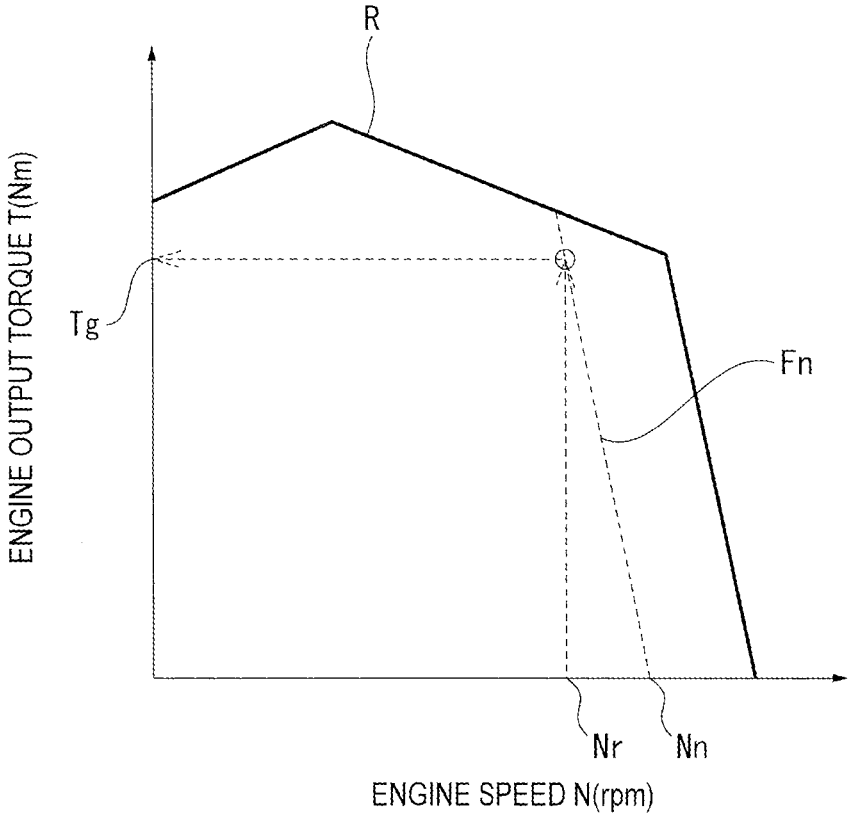
FIG. 3 illustrates a relationship between a target engine speed and an engine output torque.

The pump torque calculator 31 can calculate the engine output torque (the pump torque) with the inputted value in the pump torque calculator 31 using an illustration showing the relationship between the engine output torque T and the engine speed N as shown in FIG. 3.

Specifically, as shown in FIG. 3, an engine estimated torque Tg at that time can be obtained at a target engine speed Nn at that time, namely, an intersection between a high-speed control area Fn that is set by the command value 37 of the fuel dial 4 to correspond to the target engine speed Nn and an engine speed Nr at that time detected by the engine speed sensor 20.

The pump torque calculator 31 may alternatively calculate the engine output torque at that time based on the command value of the engine output torque (not shown) provided in the controller 7 and the engine speed detected by the engine speed sensor 20.

The pump torque calculator 31 calculates the output torque of the hydraulic pump 6 based on the pump capacity detected by the swash-plate angle sensor 39 and the pump discharge pressure detected by the pump pressure sensor and provides the calculated output torque as the engine output torque at that time.

The pump torque calculator 31, the pump pressure sensor 38, the swash-plate angle command value calculator 30, the engine speed sensor 20 and the swash-plate angle sensor 39 in combination function as a detector detecting the pump capacity of the hydraulic pump and a detector detecting the engine output torque.

The operator selects one command value of variable command values by turning a fuel dial 4 (a command unit), thereby setting a first target engine speed corresponding to the selected command value. Corresponding to the set first target engine speed, a high-speed control area where a pump absorption torque and an engine output torque are matched can be set.

Figure 4:
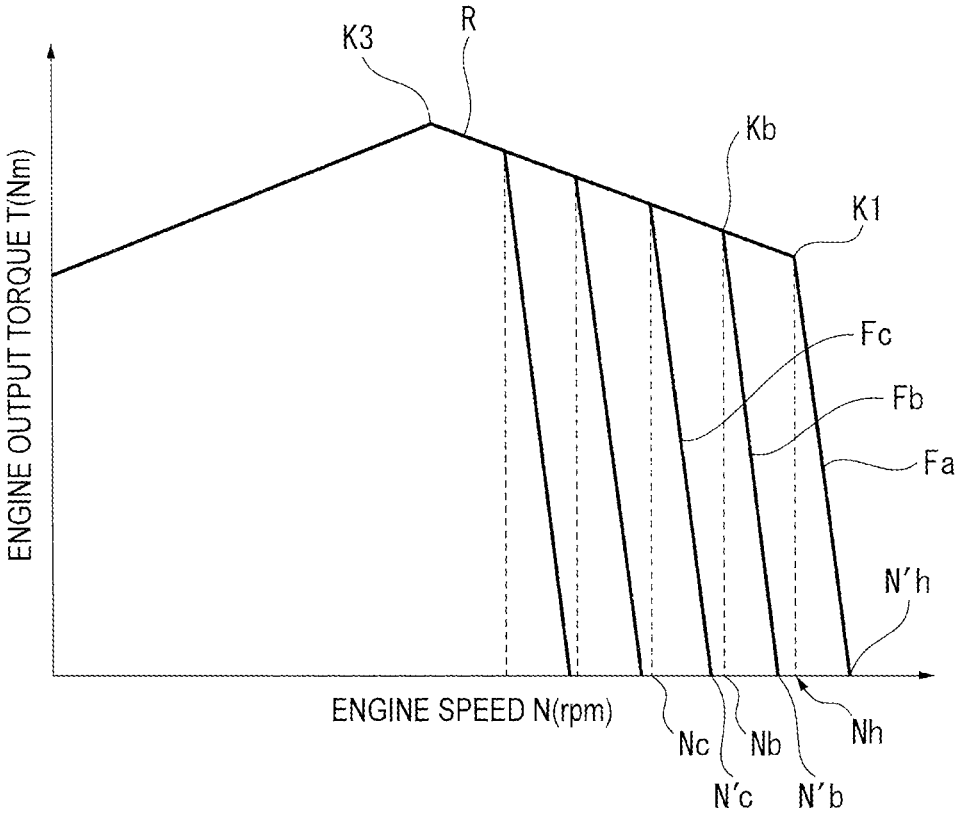
FIG. 4 shows an engine-output-torque-characteristics line.

Specifically, as shown in FIG. 4, when a target engine speed Nb(N'b) as the first target engine speed is set by turning the fuel dial 4, a high-speed control area Fb is selected corresponding to the target engine speed Nb(N'b). At this time, the target engine speed is Nb(N'b).

The first target engine speed N'b is defined as a point where the total of a non-load engine friction torque and a hydraulic loss torque and the engine output torque are matched when the target engine speed is controlled at Nb. In an actual engine control, a line connecting the first target engine speed N'b and a matching point Kb is set as the high-speed control area Fb.

Although the target engine speed N'b is exemplarily set higher than the target engine speed Nb in the following description, the target engine speed N'b and the target engine speed Nb may be the same, or the target engine speed N'b may be set lower than the target engine speed Nb. In the following description, an engine speed N'c marked with the apostrophe (e.g., a target engine speed Nc(N'c)) is described. The engine speed N'c marked with the apostrophe is defined in the same manner as the above.

When the operator newly sets a first target engine speed Nc lower than the initially selected first target engine speed Nb by turning the fuel dial 4, a high-speed control area Fc is selected in a lower speed area.

In this manner, by setting the fuel dial 4, one high-speed control area is set corresponding to the first target engine speed selectable by the fuel dial 4. Specifically, when the fuel dial 4 is set, as exemplarily shown in FIG. 4, any one of the high-speed control area Fa passing a maximum horsepower point K1 and a plurality of the high-speed control areas Fb, Fc and so forth in the lower speed area relative to the high-speed control area Fa can be set, or any one of high-speed control areas defined between the above high-speed control areas can be set.

Figure 5:
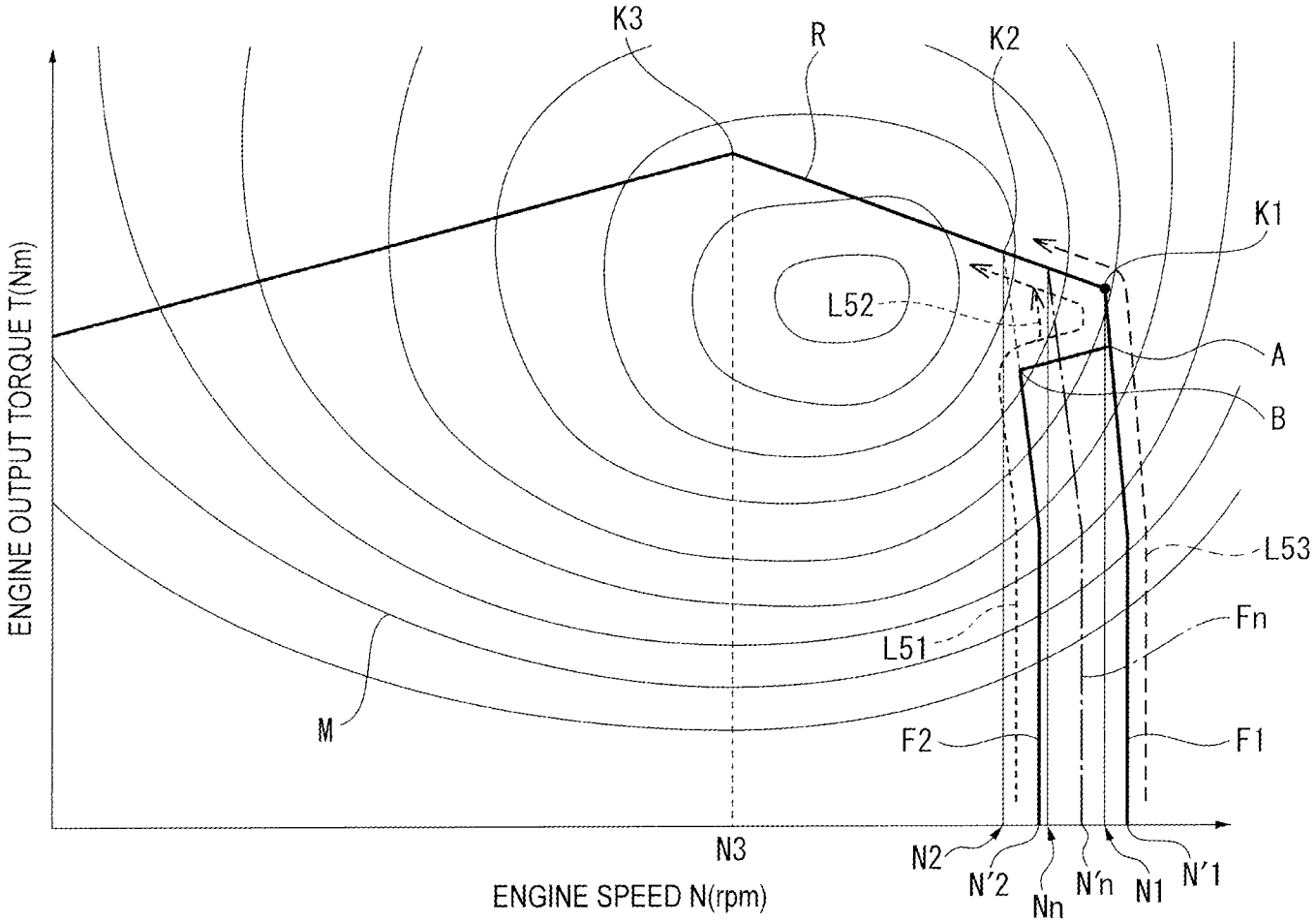
FIG. 5 shows the engine-output-torque-characteristics line when the engine output torque is increased.

In the engine-output-torque-characteristics line of FIG. 5, the possible performance of the engine 2 is shown as an area defined by a maximum torque line R. The output (horsepower) of the engine 2 peaks at the maximum horsepower point K1 on the maximum torque line R. M denotes a fuel consumption map. The minimum fuel consumption area is defined near the center of the fuel consumption map. K3 on the maximum torque line R denotes the maximum torque point where the torque of the engine 2 peaks.

Description will be made below on an explanatory situation where a first target engine speed N1 is set as the maximum target engine speed corresponding to a command value 37 of the fuel dial 4 and a high-speed control area F1 passing the maximum horsepower point K1 is set corresponding to the first target engine speed N1.

Description will be made below on an explanatory situation where the first target engine speed N1 is set as the rated engine speed corresponding to the command value of the fuel dial 4 in FIG. 1 (although the rated engine speed is denoted as Nh in FIG. 4, the rated engine speed is also denoted as the first target engine speed N1 in FIG. 5) and the high-speed control area F1 passing the maximum horsepower point K1 is set corresponding to the first target engine speed N1. However, the invention is applicable not only to the situation where the high-speed control area F1 passing the maximum horsepower point K1 is set.

For instance, even if any one of the plurality of high-speed control areas Fb, Fc and so forth or any one of the high-speed control areas defined between the high-speed control areas Fb, Fc and so forth is set as the high-speed control area corresponding to the determined first target engine speed in FIG. 4, the invention is favorably applied to the determined high-speed control area.

FIG. 5 illustrates an increasing pattern of the engine output torque. In the exemplary embodiment, the high-speed control area F1 can be set corresponding to the first target engine speed N1 that is set corresponding to the command value of the fuel dial 4 set by the operator. In the same manner, the second target engine speed N2 is set lower than the first target engine speed N1 and a high-speed control area F2 is set corresponding to the second target engine speed N2, thereby starting controlling drive of the engine based on the high-speed control area F2.

Accordingly, the high-speed control area selecting calculator 32 shown in FIG. 2 functions as a first setting unit that sets the second target engine speed N2 based on the first target engine speed N1 that is set in response to the command value 37 of the fuel dial 4.

It will be described below how to set the second target engine speed N2 lower than the first target engine speed N1 when setting the first target engine speed N1.

For controlling the hydraulic pump, in order to prevent an engine stall and an excessive decrease in the engine horsepower, the pump-absorption-torque-limit line is provided so as to keep the engine speed from being decreased to a predetermined engine speed or lower. In other words, the pump-absorption-torque-limit line is provided as a line for limiting a volume of the engine output torque absorbable by the hydraulic pump. Accordingly, the hydraulic pump capacity is limited by the pump-absorption-torque-limit line.

Figure 6:
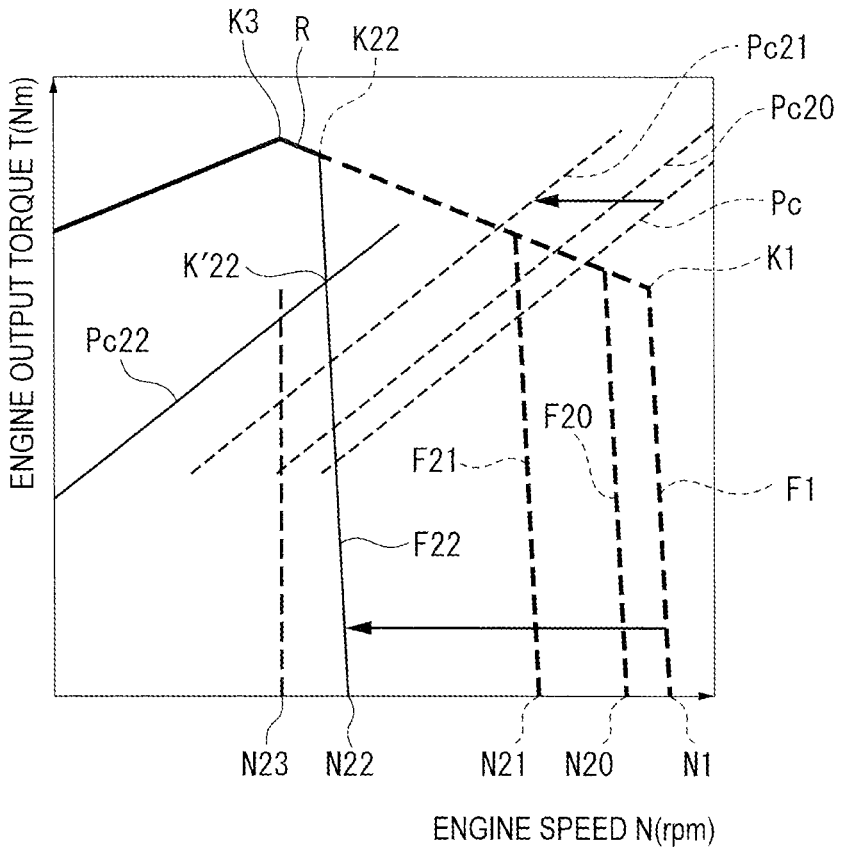
FIG. 6 illustrates a relationship between a target engine speed and a pump-absorption torque-limit line.

For instance, as shown in FIG. 6, when the first target engine speed N1 selected by the fuel dial 4 is set to engine speeds N20, N21 . . . that are decreased from the rated engine speed of the engine 2, the pump-absorption-torque-limit line Pc is configured to shift toward the lower-engine speed and higher-torque side as shown in Pc20, Pc21 . . . . In other words, the pump-absorption-torque-limit line Pc is configured to be uniformly decreased toward the lower-engine speed side as the first target engine speed N1 is decreased. Thus, prevention of the engine stall and adjustment of the engine horsepower are conducted by setting the pump-absorption-torque-limit line Pc.

The pump-absorption-torque-limit line is also configured to rapidly shift toward the lower-torque side as the first target engine speed approaches an engine speed at the maximum torque point K3. This aims for preventing generation of an engine stall which may be caused by decrease in the engine speed relative to the engine speed at the maximum torque point K3.

When the first target engine speed (e.g., an engine speed N22) approaches the engine speed at the maximum torque point K3, a pump-absorption-torque-limit line Pc22 for the first target engine speed N22 limits the engine output torque absorbable by the hydraulic pump 6.

In other words, the engine output torque absorbable by the hydraulic pump 6 is represented by an engine output torque at a matching point K'22 at the intersection between the high-speed control area F22 for the first target engine speed N22 and the pump-absorption-torque-limit line Pc22, and is kept far lower than an engine output torque at an output torque point K22 at the intersection between the high-speed control area F22 and the maximum torque line R.

When the pump-absorption-torque-limit line is thus rapidly decreased toward the lower-torque side from the maximum torque line R, if the target engine speed is set at a further lower engine speed, it is impossible to increase the pump capacity and ensure the pump discharge flow volume.

Accordingly, in the exemplary embodiment, when the first target engine speed approaches the engine speed at the maximum torque point K3, the first target engine speed N1 and the second target engine speed N2 become the same.

In the exemplary embodiment, the reduction range for decreasing the first target engine speed N1 to the second target engine speed N2 is configured to be decreased as the first target engine speed set by the fuel dial 4 is decreased. When the first target engine speed N1 set by the fuel dial 4 is lower than the engine speed at the maximum torque point K3, the reduction range for decreasing the first target engine speed N1 to the second target engine speed N2 is set at zero.

In the exemplary embodiment, the pump-absorption-torque-limit line is designed according to a simply increasing function, in which the torque is decreased as the engine speed is decreased, using the engine speed as a coefficient. The pump-absorption-torque-limit line is set according to the first target engine speed in response to the command value of the fuel dial 4. For instance, as shown in FIG. 7, a pump-absorption-torque-limit line Pc1 is set at the first target engine speed N1.

Figure 7:
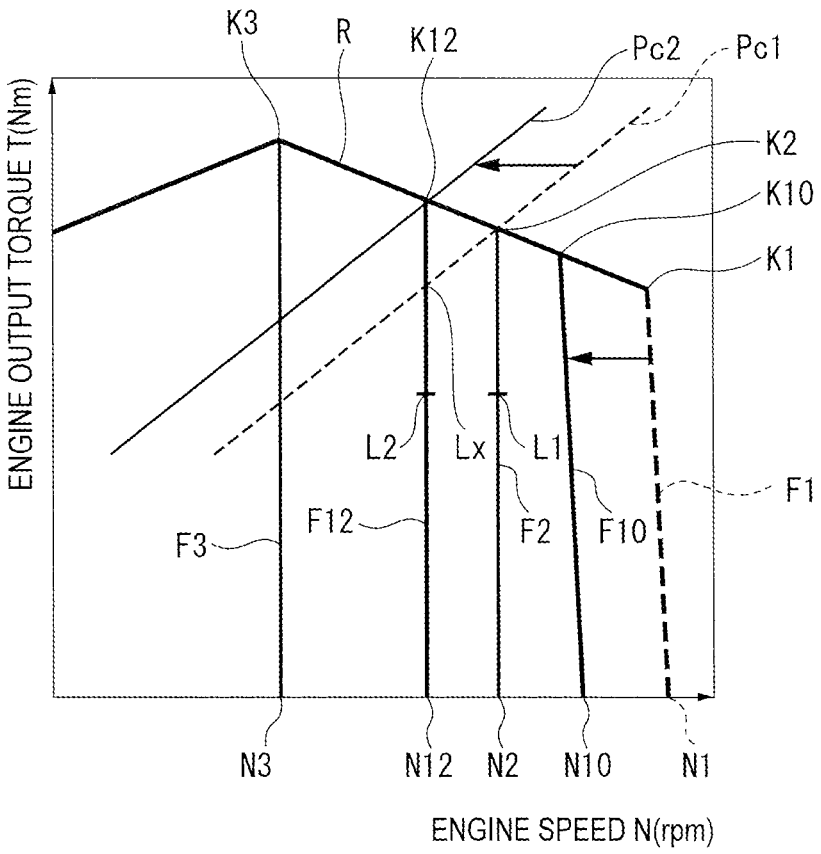
FIG. 7 illustrates setting of a second target engine speed.

When the first target engine speed is set lower than a predetermined engine speed, as shown by the arrow in FIG. 7, the pump-absorption-torque-limit line is also designed to shift from Pc1 to Pc2 according to the first target engine speed. In other words, when the first target engine speed is set lower than the predetermined engine speed, the pump-absorption-torque-limit line shifts toward the lower-engine speed and higher-torque side. Even if the model and the like of the construction machine are changed, the same command of the fuel dial enables output of the horsepower at the similar level.

Such a setting is possible that the pump-absorption-torque-limit line Pc1 does not shift in the arrow direction in FIG. 7 until, for instance, the first target engine speed is set at a predetermined engine speed N10 or lower. Moreover, until the first target engine speed is set at the predetermined engine speed N10 or lower, the second target engine speed can be set to keep the engine speed N2.

With this arrangement, when the first target engine speed is the engine speed N10 or higher, the second target engine speed can be decreased near the engine speed N2 at the intersection between the pump-absorption-torque-limit line Pct and the maximum torque line R.

As shown in FIG. 7, when the drive control of the engine 2 is conducted along the high-speed control area F2 at the target engine speed N2, even if the output torque of the engine 2 reaches the maximum torque line R, the output torque point K2 at the intersection between the high-speed control area F2 and the maximum torque line R is at the intersection between the pump-absorption-torque-limit line Pct and the maximum torque line R or near the maximum horsepower point K1 away from the intersection, the hydraulic pump 6 can absorb the engine output torque at the output torque point K2. With this arrangement, the hydraulic pump 6 can drive the engine by the engine horsepower at the output torque point K2.

However, when the drive control of the engine is conducted along a high-speed control area F12 while the pump-absorption-torque-limit line Pct is defined by setting the first target engine speed N1, the hydraulic pump 6 cannot absorb an engine output torque larger than the engine output torque at Lx of the intersection between the high-speed control area F12 and the pump-absorption-torque-limit line Pct. Accordingly, the hydraulic pump 6 is to be limited by the drive based on the engine horsepower at Lx. Thus, when the engine output torque is increased up to the intersection LX, the pump capacity is decreased and the flow volume supplied to the hydraulic actuator is decreased.

Specifically, in FIG. 7, during the engine drive control along the high-speed control area F2, for instance, when a load is rapidly applied while the engine outputs the engine output torque at L1, the engine output torque absorbable by the hydraulic pump 6 can be increased to the engine output torque at K2 from the engine output torque at L1. Accordingly, since the engine output torque absorbable by the hydraulic pump 6 can be rapidly increased, even if the load is rapidly applied, the flow volume of the pressure oil supplied to the hydraulic actuator is not decreased.

However, during the engine drive control along the high-speed control area F12, for instance, when the load is rapidly applied at L2 where the same volume of the engine output torque as that at L1 is outputted, the hydraulic pump 6 can only absorb the engine output torque between L2 and Lx where the engine output torque is limited by the pump-absorption-torque-limit line Pc1. For this reason, it is impossible to increase the engine output torque to reach one at the output torque point K2 and make the hydraulic pump 6 absorb a large engine horsepower in the same manner as in the engine drive control along the high-speed control area F2. Accordingly, the discharge flow volume is decreased when the load is rapidly applied on the hydraulic pump 6 and the flow volume of the pressure oil supplied to the hydraulic actuator is decreased. Consequently, the operator feels discomfort about operability.

For this reason, it is preferable that the second target engine speed is exemplarily the engine speed at the intersection between the pump-absorption-torque-limit line Pc1 and the maximum torque line R or near the maximum horsepower point away from the intersection. It is exemplarily shown in Figures that the engine speed at the intersection between the pump-absorption-torque-limit line Pc1 and the maximum torque line R is defined as the second target engine speed N2.

In other words, it is preferable to set the second target engine speed in accordance with increase or decrease in the engine speed at the matching point between the pump-absorption-torque-limit line and the maximum torque line R.

In the exemplary embodiment, as shown in FIG. 7, until the first target engine speed N1 is set at the engine speed N10 or lower, the second target engine speed is set at a constant engine speed represented by N2. Specifically, when the high-speed control area is selected in a range between the high-speed control area F1 and the high-speed control area F10 according to the first target engine speed in response to the command value of the fuel dial 4, the target engine speed N2 is set as the second target engine speed. Then, the drive control of the engine is conducted along the high-speed control area F2 corresponding to the second target engine speed N2.

This will be described with reference to FIG. 11 in which the abscissa axis represents the first target engine speed and the ordinate axis represents the second target engine speed. When the first target engine speed is set at 2000 rpm (represented as the engine speed N10 in FIG. 7) or higher, the second target engine speed is constantly set at 1800 rpm (represented as the engine speed N2 in FIG. 7).

Referring back to FIG. 7, when the first target engine speed is set in a range from an engine speed N3 at the maximum torque point K3 to the engine speed N10, it is preferable to set as the second target engine speed the target engine speed N12 or higher at the output torque point K12 of the intersection between the pump-absorption-torque-limit line Pc2 and the maximum torque line R, when the pump-absorption-torque-limit line shifts to Pc2 corresponding to the determined first target engine speed. It is exemplarily shown in Figures that the engine speed N12 is set as the second target engine speed.

This will be described with reference to FIG. 11. The reduction range for decreasing the first target engine speed to the second target engine speed N12 is set to be linearly decreased as shown by the solid line in FIG. 11 as the first target engine speed becomes the engine speed 2000 rpm or lower and is decreased near the engine speed 1500 rpm at the maximum torque point K3. In FIG. 11, the second target engine speed can be set corresponding to the first target engine speed that is set between the engine speed 1500 rpm and the engine speed 2000 rpm.

Referring back to FIG. 7, when the first target engine speed is set at the engine speed N3 or lower, the second target engine speed is matched with the first target engine speed. In short, the reduction range is set at zero.

This will be described with reference to FIG. 11. When the first target engine speed is 1500 rpm or lower, the reduction range for decreasing the first target engine speed to the second target engine speed N12 is set at zero to match the second target engine speed with the first target engine speed.

Figure 11:
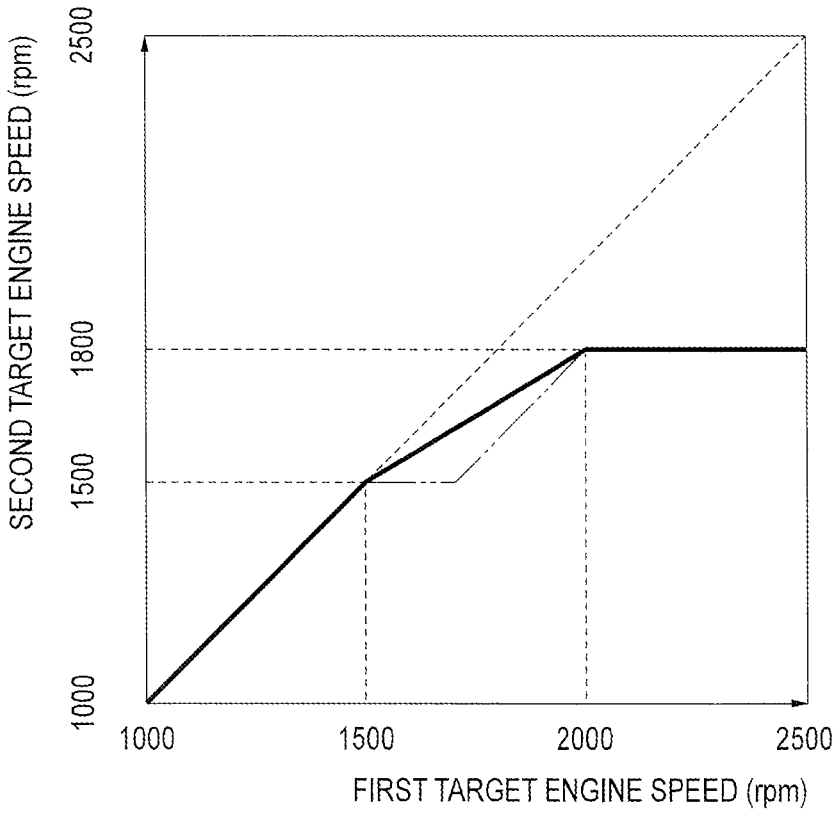
FIG. 11 illustrates a relationship between the first target engine speed and the second target engine speed.

It should be noted that the specific values of the first and second target engine speeds shown in FIG. 11 are exemplary, which by no means limit the invention. The values of the first and second target engine speeds are changeable according to the properties of the engine, the hydraulic pump and the like mounted in the construction machine.

With this arrangement, conditions for setting the second target engine speed based on the first target engine speed that is set in response to the command value 37 of the fuel dial 4 can be determined. Further, as the command value 37 of the fuel dial 4 is smaller, in other words, the first target engine speed is set lower, the difference between the first target engine speed and the second target engine speed can be made smaller. Accordingly, since the second target engine speed can be set further lower as the first target engine speed is decreased, fuel efficiency is further attainable.

By setting the reduction range for decreasing the first target engine speed to the second target engine speed to be continuously (linearly) decreased, the operator does not feel discomfort caused by a situation where the second target engine speed fails to be decreased although the first target engine speed is decreased by the fuel dial.

When the command value 37 of the fuel dial 4 is a predetermined value or smaller, in other words, when the first target engine speed is set at the engine speed at the maximum torque point K3 or lower, the second target engine speed can be set at the same engine speed as the first target engine speed. Accordingly, since the engine drive control is conducted based on the first target engine speed, the operator does not feel discomfort about operability.

Further, until the pump-absorption-torque-limit line shifts according to the first target engine speed to be changed, the second target engine speed can be set at a predetermined constant engine speed irrespective of the value of the first target engine speed.

Since the relationship between the first and second target engine speeds can be thus set, when the second target engine speed is set in response to the command value 37 of the fuel dial 4, a sufficient pump absorption torque required in the hydraulic pump can be ensured while a fuel efficiency is significantly improved.

When the first target engine speed in response to the command value 37 of the fuel dial 4 approaches the engine speed N3 at the maximum torque point K3, the pump-absorption-torque-limit line needs to be decreased toward the lower-torque side in order to prevent the engine stall. At that time, if the second target engine speed is simply set by a fixed reduction range based on the first target engine speed, when the load is rapidly applied, the pump capacity is limited by the pump-absorption-torque-limit line in accordance with the increase in the engine output torque.

In contrast, in the exemplary embodiment, the reduction range by which the first target engine speed is decreased to the second target engine speed is set to be continuously decreased as the first target engine speed is decreased.

Moreover, the reduction range is set at zero when the first target engine speed reaches the engine speed N3 at the maximum torque point K3. When the first target engine speed reaches the engine speed N3 at the maximum torque point K3, the pump-absorption-torque-limit line is set on the high-speed control area of the first target engine speed. This is because setting the second target engine speed lower than the first target engine speed causes the pump capacity to become insufficient when the load is rapidly applied.

Next, with reference to FIGS. 5 and 12, the engine drive control by the second target engine speed N2 along the high-speed control area F2 will be described.

During the drive control of the engine 2 along the high-speed control area F2 based on the second target engine speed N2, the drive control continues until the pump capacity D of the hydraulic pump 6 reaches a predetermined second pump capacity D2. For instance, the drive control along the high-speed control area F2 continues until the engine output torque reaches the point B.

When the pump capacity D of the hydraulic pump 6 becomes equal to or exceeds the second pump capacity D2, the target engine speed N of the engine 2 is calculated based on a predetermined relationship between the pump capacity D and the target engine speed N.

Thus, the drive control of the engine 2 is conducted based on the target engine speed to shift from the high-speed control area F2 to the high-speed control area F1. When the pump capacity D of the hydraulic pump 6 driven by the engine 2 reaches the predetermined first pump capacity D1 (D1>D2), the drive control of the engine 2 is conducted along the high-speed control area F1 based on the first target engine speed N1. For instance, the drive control is conducted along the high-speed control area F1 when the engine output torque reaches a point A of a first setting position.

In FIG. 5, a position where the pump capacity D of the hydraulic pump 6 becomes the second pump capacity D2 is represented by a second setting position B and a position where the pump capacity D of the hydraulic pump 6 becomes the first pump capacity D1 is represented by the first setting position A.

When the load applied on the hydraulic actuator 10 is increased after the shift to the high-speed control area F1, the engine output torque is increased along the high-speed control area F1. When the load applied on the hydraulic actuator 10 is increased in the high-speed control area F1, the engine output torque is increased up to the maximum horsepower point K1.

After the load applied on the hydraulic actuator 10 is increased and the engine output torque T reaches the maximum torque line R between the high-speed control area F1 and the high-speed control area F2 or reaches the maximum horsepower point K1 in the high-speed control area F1, the engine speed and the engine output torque are thereafter matched on the maximum torque line R.

Since the high-speed control area is shiftable as described above, the working equipment is capable of consuming the maximum horsepower as ever when the shift to the high-speed control area F1 is done.

The control for decreasing the engine output torque along the high-speed control area is conducted in the same manner as the control for increasing the engine output torque along the high-speed control area. The above controls are described in detail in WO 2009/104636 described above.

Next, description will be made on the control flow of FIG. 9.

Figure 9:
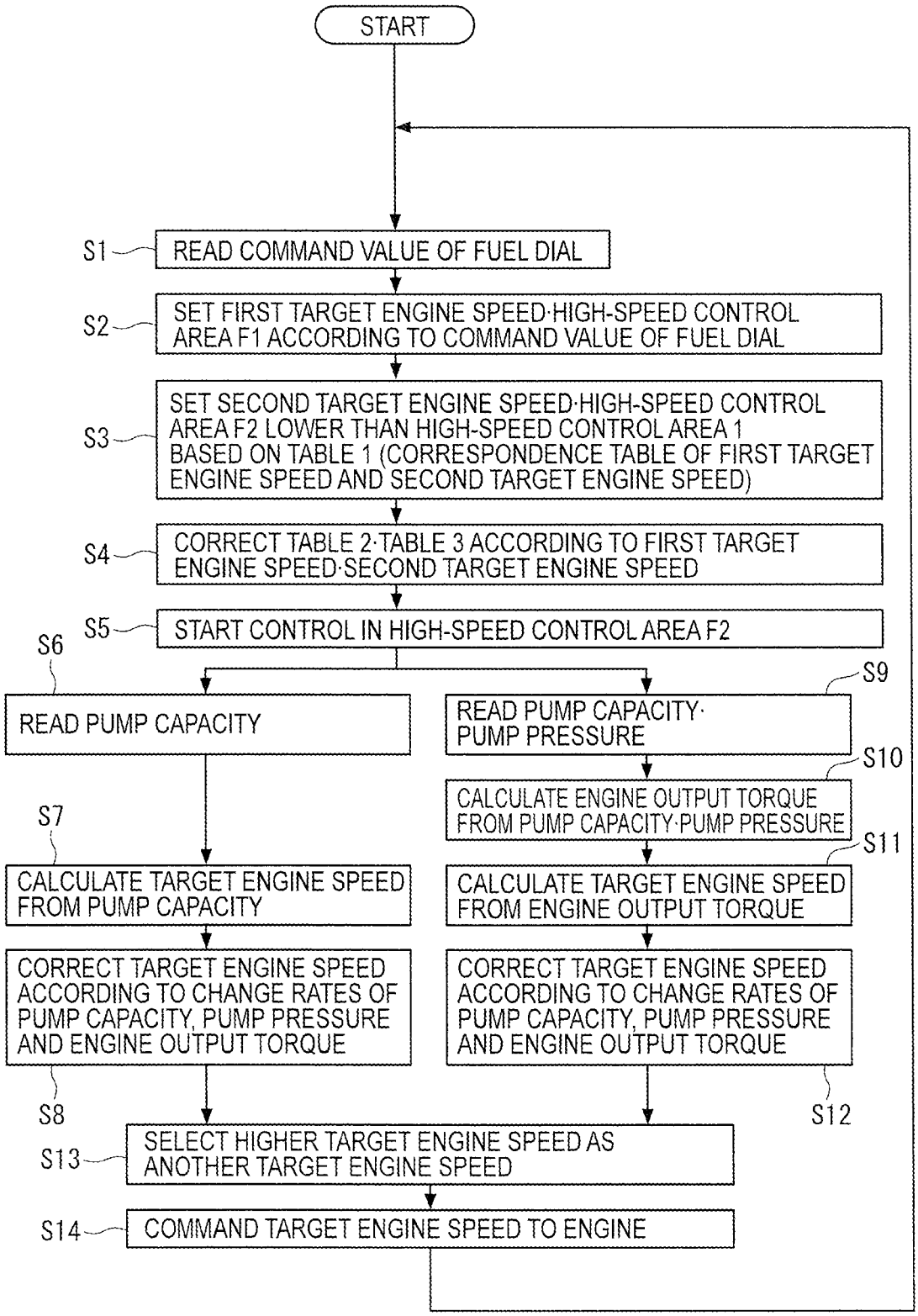
FIG. 9 is a control flow chart according to the invention.

In Step S1 of FIG. 9, the controller 7 reads the command value 37 of the fuel dial 4. The process then proceeds to Step S2.

In Step S2, the controller 7 sets the first target engine speed N1 in response to the read command value 37 of the fuel dial 4, whereby the high-speed control area F1 is set based on the set first target engine speed N1.

Although it is described above that the first target engine speed N1 of the engine 2 is initially set in response to the command value 37 of the fuel dial 4, the controller 7 can initially set the high-speed control area F1 and the first target engine speed N1 corresponding to the set high-speed control area F1. Alternatively, the controller 7 can simultaneously set both the first target engine speed N1 and the high-speed control area F1 in response to the read command value 37 of the fuel dial 4.

As shown in FIG. 5, when the first target engine speed N1 and the high-speed control area F1 are set, the process proceeds to Step S3.

In Step S3, the high-speed control area selecting calculator 32 shown in FIG. 2 sets the second target engine speed N2, which is set at the lower-engine speed area in advance corresponding to the first target engine speed N1, and the high-speed control area F2 corresponding to the target engine speed N2.

Figure 10A:
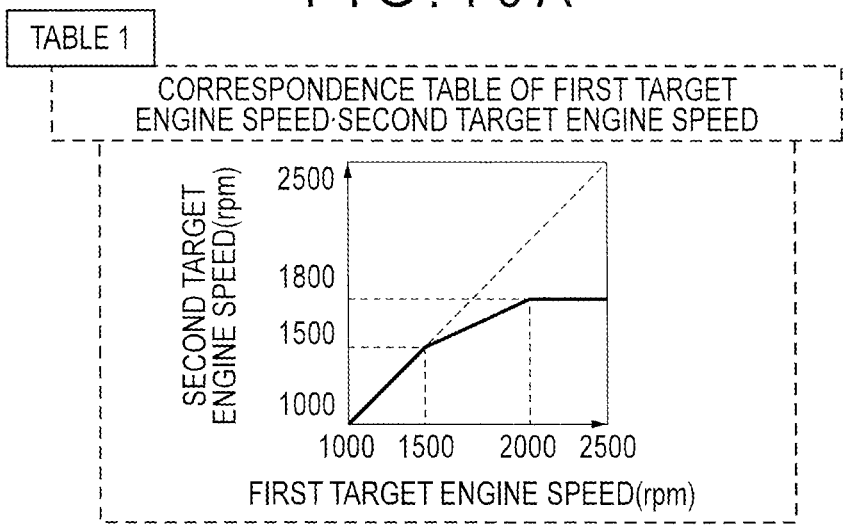
FIG. 10A illustrates a relationship between a first target engine speed and the second target engine speed.

In other words, based on the relationship between the first target engine speed N1 and the second target engine speed N2 shown in Table 1 of FIG. 10A, the second target engine speed N2 and the high-speed control area F2 can be set.

FIG. 11 shows an enlarged view of Table 1 of FIG. 10A. The values of the engine speed shown in Table 1 of FIG. 10A and FIG. 11 are taken as an example and any value may be set as needed according to a construction machine.

Thus, using Table 1 of FIG. 10A, the high-speed control area F2 that is located in the engine speed area lower than the high-speed control area F1 set by the fuel dial 4 can be set in advance as a high-speed control area corresponding to each high-speed control area F1.

After the controller 7 sets the high-speed control area F2, the process proceeds to Step S4.

Figure 10B:
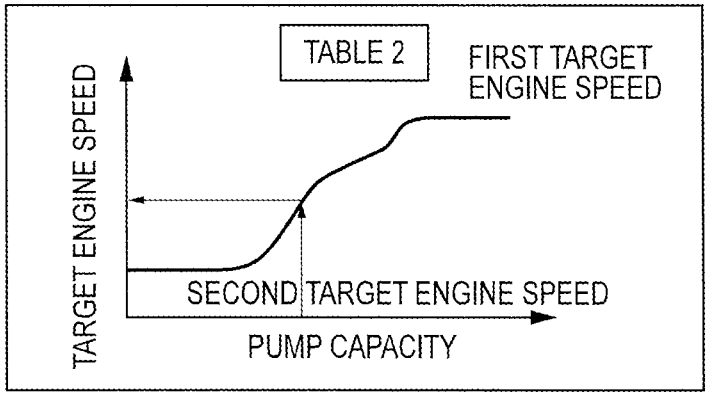
FIG. 10B illustrates a relationship between a pump capacity and the target engine speed.
Figure 10C:
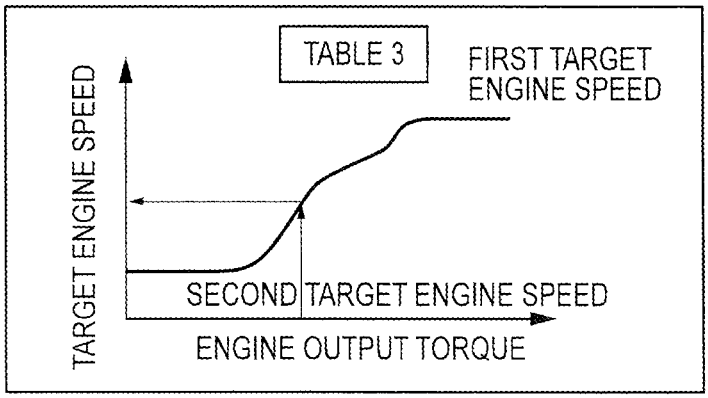
FIG. 10C illustrates a relationship between the engine output torque and the target engine speed.

In Step S4, the target engine speed is calculated corresponding to the determined first target engine speed N1 and second target engine speed N2, using Table 2 for setting the target engine speed based on the pump capacity (FIG. 10B) and Table 3 for setting the target engine speed based on the engine output torque (FIG. 10C). Then, the process proceeds to Step S5.

In other words, in Step S4, the first target engine speed N1 (the upper limit) and the second target engine speed N2 (the lower limit) in Table 2 of FIG. 10B and Table 3 of FIG. 10C are respectively corrected to be the first target engine speed N1 and the second target engine speed N2 set in Step S3. In Table 2 of FIG. 10B and Table 3 of FIG. 10C, the first target engine speed N1 is set as the upper limit value of the target engine speed N and the second target engine speed N2 is set as the lower limit thereof.

When the first target engine speed N1 and the second target engine speed N2 are corrected in Table 2 of FIG. 10B and Table 3 of FIG. 10C, a curve between the first target engine speed N1 and the second target engine speed N2 in Table 2 of FIG. 10B and Table 3 of FIG. 10C can be set in a similar figure according to a difference in the engine speed between the first target engine speed N1 and the second target engine speed N2. Alternatively, the curve can be set in advance according to a combination of the first target engine speed N1 and the second target engine speed N2. The curve can be set by any other methods as needed.

In Step S5, the drive control of the engine 2 is started in the high-speed control area F2 corresponding to the set second target engine speed N2, and then the process proceeds to Steps S6 or Step S9.

When the drive control of the engine 2 is conducted at the target engine speed N corresponding to the detected pump capacity D, Steps S6 to Step S8 are conducted.

When the drive control of the engine 2 is conducted at the target engine speed N corresponding to the detected engine output torque T, Steps S9 to Step S12 are conducted.

Description will first be made on Steps S6 to Step S8 as control steps for obtaining the target engine speed corresponding to the detected pump capacity.

In Step S6, the swash-plate angle sensor 39 reads out the detected pump capacity D of the hydraulic pump 6. After reading the pump capacity D in Step S6, the process proceeds to Step S7. It should be noted that the pump capacity D may be calculated based on the aforementioned relationship among the pump discharge pressure P, the discharge volume D (the pump capacity D) and the engine output torque T.

The following is a brief description on the process in Step S9 for obtaining the target engine speed N corresponding to the detected pump capacity D. In other words, as shown in FIG. 12, the engine drive control based on the second target engine speed N2 continues until the pump capacity D of the hydraulic pump 6 reaches the predetermined second pump capacity D2.

Figure 12:
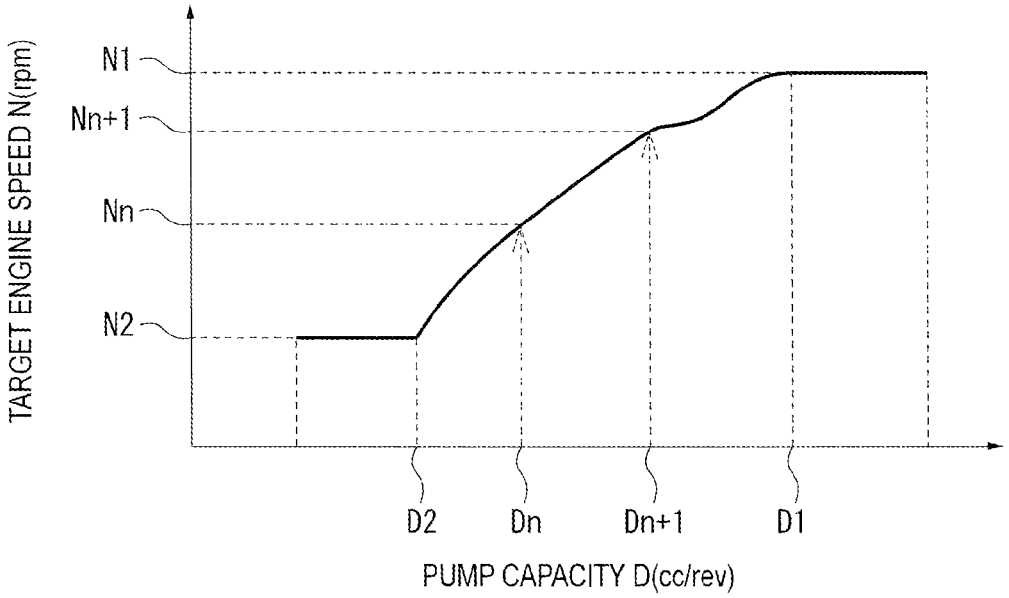
FIG. 12 illustrates a relationship between the pump capacity and the target engine speed.

When the detected pump capacity D of the hydraulic pump 6 becomes equal to or exceeds the second pump capacity D2, the target engine speed N corresponding to the detected pump capacity D is calculated based on the preset relationship between the pump capacity D and the target engine speed N shown in FIG. 12. At this time, the drive of the engine 2 is controlled so that the engine 2 is driven at the calculated target engine speed Nn.

Until the target engine speed Nn is increased to reach the first target engine speed N1 or the target engine speed Nn is decreased to reach the second target engine speed N2, the target engine speed Nn corresponding to the detected pump capacity Dn is constantly calculated. The drive control of the engine 2 is thus constantly conducted at the calculated target engine speed Nn. In this control, the high-speed control area selecting calculator 32 functions as a second setting unit that sets the target engine speed corresponding to the pump capacity, the target engine speed having the second target engine speed as the lower limit.

When the currently-detected pump capacity D is the pump capacity Dn, the target engine speed N is obtained as the target engine speed Nn. Upon detection of an increase from the pump capacity Dn to a pump capacity Dn+1, a target engine speed Nn+1 corresponding to the pump capacity Dn+1 is newly obtained according to FIG. 12. The drive control of the engine 2 is thus conducted so that the engine 2 is driven at this newly-obtained target engine speed Nn+1.

When the detected pump capacity D reaches the predetermined first pump capacity D1, the drive control of the engine 2 is conducted based on the first target engine speed N1. When the drive control of the engine 2 is conducted based on the first target engine speed N1, the drive control of the engine 2 continues based on the first target engine speed N1 until the pump capacity D of the hydraulic pump 6 becomes equal to or less than the first pump capacity D1.

When the detected pump capacity D reaches the maximum torque line R as shown in FIG. 5 while being kept between the predetermined first pump capacity D1 and the predetermined second pump capacity D2, the engine control is conducted along the maximum torque line R.

Referring back to FIG. 9, the description on control Step S7 will be continued. In Step S7, the target engine speed N corresponding to the detected pump capacity D is obtained based on the preset relationship between the pump capacity D and the target engine speed N as shown in Table 2 of FIG. 10B, and then the process proceeds to Step S8.

In Step S8, the value of the target engine speed N is corrected according to the change rate of the pump capacity of the hydraulic pump 6, the change rate of the pump discharge pressure, or the change rate of the engine output torque T. In other words, when these change rates (i.e. increase rates) are high, it is also possible to correct the target engine speed N to a higher one.

Step S8, described above as a control step for correcting the value of the target engine speed N, may be skipped.

Next, description will be made on Step S9 to Step S12 as control steps for obtaining the target engine speed corresponding to a detected engine output torque.

In Steps S9 to S12, the pump torque calculator 31 is configured to output the engine output torque T (the pump torque T) in response to the command value signal from the swash-plate angle command value calculator 30 and the detection signal from the pump pressure sensor 38 in FIG. 2. However, the detection signal from the swash-plate angle sensor 39 and the detection signal from the pump pressure sensor 38 may alternatively be used for detecting the engine output torque T as described above.

In Step S9, for instance, the detection signals from the swash-plate angle sensor 39 and the pump pressure sensor 38 are read out, and then the process proceeds to Step S10.

In Step S10, the engine output torque T is calculated based on the detection signals on the pump capacity and the pump pressure read out in Step S9. After the engine output torque T is calculated, the process proceeds to Step S11.

Figure 13:
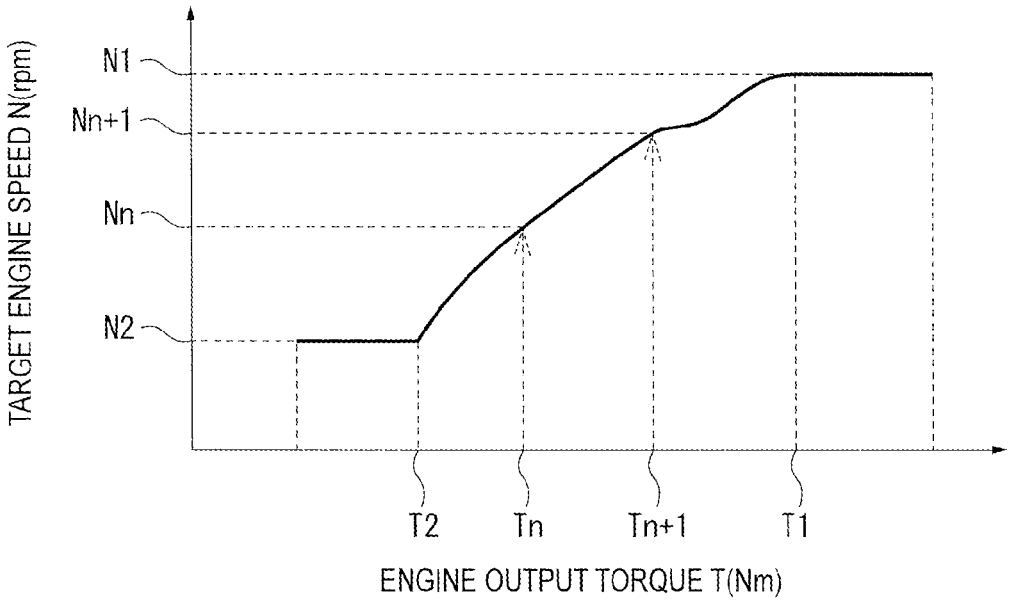
FIG. 13 illustrates a relationship between the engine output torque and the target engine speed.

The following is a brief description on the process at Step S11 for obtaining the target engine speed N corresponding to the detected engine output torque T. As shown in FIG. 13, when the drive control of the engine is conducted based on the second target engine speed N2, the drive control of the engine continues based on the second target engine speed N2 until the detected engine output torque T reaches a predetermined second engine output torque T2.

When the detected engine output torque T becomes equal to or exceeds the predetermined second engine output torque T2, the target engine speed N corresponding to the detected engine output torque T is obtained based on the preset relationship between the engine output torque T and the target engine speed N shown in FIG. 13. The drive of the engine 2 is controlled so that the engine 2 is driven at the obtained target engine speed N.

Until the target engine speed N reaches the first target engine speed N1 or the second target engine speed N2, the target engine speed N corresponding to the detected engine output torque T is continually obtained, whereby the drive control of the engine 2 is thus conducted based on the target engine speed N.

For instance, when the currently-detected engine output torque T is defined as an engine output torque Tn, the target engine speed N is defined as the target engine speed Nn. By detecting that the engine output torque T is varied from the engine torque Tn to an engine torque Tn+1, the target engine speed Nn+1 corresponding to the engine output torque Tn+1 is newly obtained. The drive control of the engine 2 is thus conducted so that the engine 2 is driven at this newly-obtained target engine speed Nn+1.

When the detected engine output torque T reaches the predetermined first engine output torque T1, the drive control of the engine 2 is conducted based on the first target engine speed N1. When the drive control of the engine 2 is conducted based on the first target engine speed N1, the drive control of the engine 2 continues based on the first target engine speed N1 until the detected engine output torque T becomes equal to or less than the predetermined first engine output torque T1.

Figure 8:
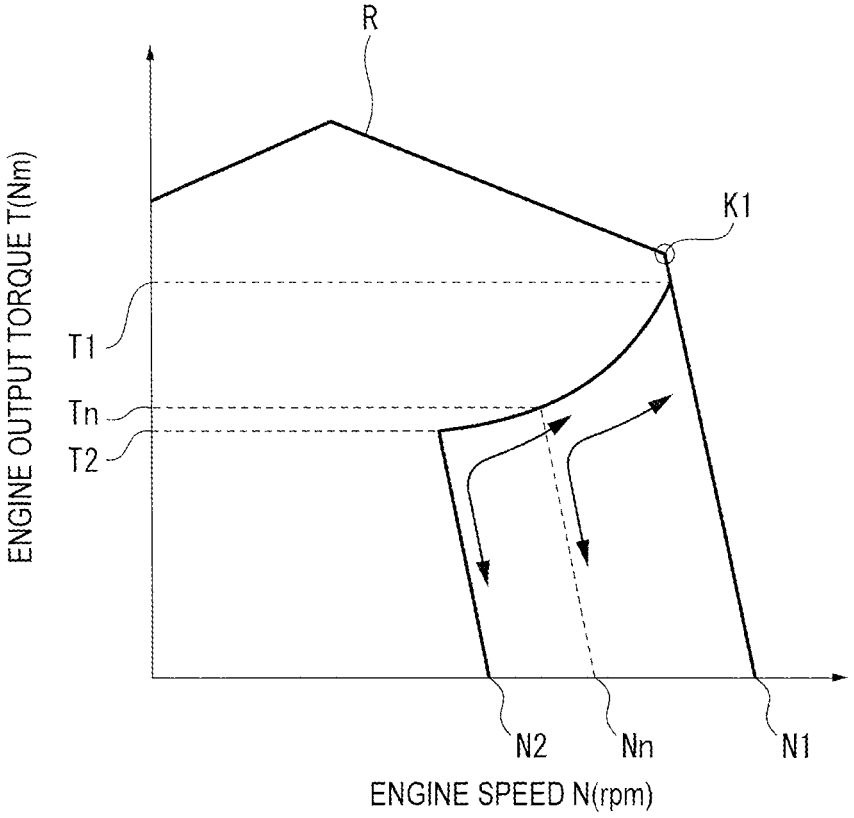
FIG. 8 illustrates a relationship between the target engine speed and the engine output torque.

Thus, when the detected engine output torque T reaches the predetermined engine output torque T2, by conducting the drive control of the engine 2 based on the first target engine speed N1, the engine output torque line is allowed to pass through the maximum horsepower point K1 of the engine 2 as shown in FIG. 8.

Referring back to FIG. 9, the description on control Step S11 will be continued. In Step S11, the target engine speed N corresponding to the detected engine output torque T is obtained based on Table 3 (FIG. 10C) showing the preset relationship between the engine output torque T and the target engine speed N, and then the process proceeds to Step S12.

In Step S12, the value of the target engine speed N is corrected according to the change rate of the pump capacity of the hydraulic pump 6, the change rate of the pump discharge pressure, or the change rate of the engine output torque T. In other words, when these change rates (i.e. increase rates) are high, it is also possible to correct the target engine speed N to a higher one.

Step S12, described above as a control step for correcting the value of the target engine speed N, may be skipped.

When a higher one between the target engine speed N corresponding to the detected pump capacity D and the target engine speed N corresponding to the detected engine output torque T is used, both the control processes of Steps S6 to S8 and Steps S9 to S12 are performed. In this case, a control in Step S13 is performed after Step S8 and Step S12.

When the drive control of the engine 2 is conducted based on the target engine speed N corresponding to the detected pump capacity D or the target engine speed N corresponding to the detected engine torque T, the control of Step S13 is skipped and the process proceeds to Step S14. In other words, when only one of the control of Steps S6 to S8 and the control of Steps S9 to S12 is conducted, the control of Step S13 is skipped and the process proceeds to Step S14.

In Step S13, a higher one of the target engine speed N corresponding to the detected pump capacity D and the target engine speed N corresponding to the detected engine output torque T is selected. After the higher target engine speed N is selected, the process proceeds to Step S14.

In Step S14, the high-speed control area selecting calculator 32 outputs the command value as shown in FIG. 2 so as to conduct the drive control of the engine using the target engine speed N. In this control, the high-speed control area selecting calculator 32 functions as a controller that controls a fuel injector so as to provide the target engine speed obtained by the second setting unit. When the control of Step S14 is conducted, the process returns to Step S1 for repeating the control.

Next, a brief description will be made on a control during an operation with reference to FIG. 1. Specifically, when the operator sets the first target engine speed N1 by operating the fuel dial 4, the second target engine speed N2 is set based on the relationship between the first target engine speed N1 and the second target engine speed N2 in FIG. 11. The drive control of the engine can be conducted along the high-speed control area F2 corresponding to the second target engine speed N2.

Description will be made on a control that is performed by detecting the pump capacity D when an operator deeply moves the operation lever 11*a* to accelerate the work equipment speed of a hydraulic excavator. Description on a control performed by detecting the engine output torque T is omitted because it is similar to the control performed by detecting the pump capacity D.

When the operation lever 11*a* shown in FIG. 1 is deeply moved so that the control valve 9 is switched to, for instance, the (I) position, an opening area 9*a* of the control valve 9 at the (I) position is increased and a differential pressure is reduced between the pump discharge pressure in the oil discharge path 25 and the load pressure in the pilot oil path 28. At this time, the pump control device 8, configured as a load sensing control device, operates for increasing the pump capacity D of the hydraulic pump 6.

The predetermined second pump capacity D2 can be set lower than the maximum pump capacity of the hydraulic pump 6. Description will be made below on an explanatory situation where a predetermined pump capacity is set as the predetermined second pump capacity D2. When the pump capacity of the hydraulic pump 6 is increased to the predetermined second pump capacity D2, the target engine speed N is controlled to change from the second target engine speed N2 to the target engine speed N corresponding to the detected pump capacity D as shown in FIG. 12.

The situation where the pump capacity of the hydraulic pump 6 reaches the predetermined second pump capacity D2 can be detected using the following various parameter values. The detector of the pump capacity can be provided by a detector capable of detecting various parameter values described below.

When the value of the engine output torque T is used as the values of the parameters for detecting the pump capacity D of the hydraulic pump 6, the controller 7 can specify a position on the high-speed control area F2 corresponding to the engine speed detected by the engine speed sensor 20 based on the engine-output-torque-characteristics line stored in the controller 7.

The value of the engine output torque at that time can be obtained based on the specified position. Thus, by using the value of the engine output torque as the parameter value, a situation where the discharge volume from the hydraulic pump 6 on the high-speed control area F2 reaches the maximum discharge volume that is dischargeable from the hydraulic pump 6.

When the pump capacity of the hydraulic pump 6 is used as the parameter value, the relationship in the hydraulic pump 6 between the pump discharge pressure P, the discharge capacity D (pump capacity D), and the engine output torque T is expressed by the equation of $T=P\cdot D/200\pi$. The pump capacity of the hydraulic pump 6 at that time is obtainable according to an equation of $D=200\cdot T/P$ using the above equation. As the engine output torque T, for instance, a command value of the engine output torque held in the controller is usable.

Based on thus obtained pump capacity of the hydraulic pump 6, a situation where the pump capacity of the hydraulic pump 6 on the high-speed control area F2 reaches the predetermined second pump capacity D2 is detectable.

When the operator further deeply moves the operation lever 11*a* after the pump capacity of the hydraulic pump 6 reaches the predetermined second pump capacity D2 on the high-speed control area F2, the drive control of the engine 2 is conducted so that the engine 2 is driven at the target engine speed N corresponding to the detected pump capacity D shown in FIG. 12. At this time, a control is sequentially conducted for shifting the high-speed control area to an optimal one within a range between the high-speed control area F2 and the high-speed control area F1.

When the load applied on the hydraulic actuator 10 is increased after the shift to the high-speed control area F1, the engine output torque is increased. When the load applied on the hydraulic actuator 10 is increased in the high-speed control area F1, the pump capacity D of the hydraulic pump 6 is increased to the maximum pump capacity and the engine output torque is increased to the maximum horsepower point K1. After the load applied on the hydraulic actuator 10 is increased and the engine output torque T reaches the maximum torque line R between the high-speed control area F1 and the high-speed control area F2 or reaches the maximum horsepower point K1 in the high-speed control area F1, the engine speed and the engine output torque are thereafter matched on the maximum torque line R.

Since the high-speed control area is shiftable as described above, the working equipment is capable of consuming the maximum horsepower as ever when the shift to the high-speed control area F1 is done.

In other words, when the shift from the high-speed control area F2 to the high-speed control area F1 is done, the engine output torque is increased toward the maximum torque line R along a dotted line L51 shown in FIG. 5. A dotted line L52 represents a pattern of an increase directly toward the maximum torque line R at the high-speed control area Fn defined in the middle of the shift from the high-speed control area F2 to the high-speed control area F1. A dotted line L53 represents a conventional pattern where a control is performed while the high-speed control area F1 is fixed. Since the target engine speed N is variable according to the value of the detected pump capacity D, the high-speed control area Fn is also variable.

Other ways of determining the second position B are as follows. Specifically, when a differential pressure between the discharge pressure from the hydraulic pump 6 and the load pressure of the hydraulic actuator 10 falls below a load sensing differential pressure, it is judged that the discharge flow volume from the hydraulic pump 6 is insufficient. The second setting position B is then determined when the differential pressure equal to the load sensing differential pressure starts to be decreased.

At this time, the pump discharge flow volume is insufficient on the high-speed control area F2. In other words, it can be judged that the hydraulic pump 6 reaches the predetermined second pump capacity D2. Accordingly, a control to shift the high-speed control area F2 toward the higher-engine speed area is conducted such that the engine can be rotated in the higher-engine speed area.

In the above-described example, the hydraulic circuit is exemplified by the one including the load sensing control device. However, in a method for obtaining the pump capacity of the hydraulic pump 6 from an actual measured value of the engine speed and the engine-output-torque-characteristics line and a method for directly obtaining the pump capacity using the swash-plate angle sensor of the pump, the same applies to an open center type hydraulic circuit.

As described above, in the invention, the drive control of the engine can be started based on the second target engine speed N2 or the high-speed control area F2 at an improved fuel efficiency of the engine when the high-speed control area F1 is set according to the first target engine speed N1 in response to the command value of the fuel dial 4 by the operator, and the second target engine speed N2 and the high-speed control area F2 of the low-speed side are set in advance corresponding respectively to the set first target engine speed N1 and the set high-speed control area F1.

Moreover, the relationship between the first target engine speed N1 and the second target engine speed N2 can be provided as shown in FIG. 11. Although an exemplary configuration in which the second target engine speed is linearly decreased as the first target engine speed N1 is decreased is shown in FIG. 11, the second target engine speed may be decreased in a curve as the first target engine speed N1 is decreased.

Moreover, the second target engine speed may be set to become constant after being decreased for some time as shown by a chain double-dashed line when the first target engine speed is in the range of 1500 rpm and 2000 rpm in FIG. 11. However, it is preferable to set the reduction range for decreasing the first target engine speed N1 to the second target engine speed N2 as a continuously decreasing value when the first target engine speed is in the range of 1500 rpm and 2000 rpm. This is because the engine speed cannot be decreased in the constant second target engine speed area even though the command value 37 of the fuel dial 4 (see FIG. 2) is decreased, resulting in discomfort of the operator.

In the exemplary embodiment, in an area where a large pump capacity is not necessary, the engine speed is controllable based on the second target engine speed N2 in the lower-engine speed area, thereby improving the fuel efficiency of the engine. The drive control of the engine can be conducted so that the engine is driven at the target engine speed N determined in advance corresponding to the detected pump capacity D, whereby a sufficient operation speed required to operate a working equipment is obtainable.

Further, in order to reduce the engine output torque T from a situation where the engine output is high, the drive control of the engine is conducted so that the engine is driven at the target engine speed N determined in advance corresponding to the detected pump capacity D, which results in an improvement in fuel efficiency.

The invention claimed is:

1. An engine control device comprising:

a variable displacement hydraulic pump driven by an engine;

a hydraulic actuator driven by a discharge pressure oil from the hydraulic pump;

a control valve that controls the discharge pressure oil from the hydraulic pump so that the discharge pressure oil is supplied to and discharged from the hydraulic actuator;

a pump capacity detector that detects a pump capacity of the hydraulic pump;

a fuel injector that controls a fuel supplied to the engine;

a command unit that selects a set command value among variable command values and commands the set command value;

a first setting unit that sets a first target engine speed in response to the set command value commanded by the command unit and a second target engine speed based on the first target engine speed, the second target engine speed being equal to or lower than the first target engine speed;

a second setting unit that sets a third target engine speed according to the pump capacity, the third target engine speed having the first target engine speed as an upper limit and the second target engine speed as a lower limit; and a controller that controls the fuel injector so as to provide the third target engine speed set by the second setting unit, wherein the first setting unit is configured to, based on the first target engine speed being reduced, decrease a reduction range from the first target engine speed to the second target engine speed, and further to either keep the second target engine speed constant or decrease the second target engine speed, and the reduction range is set at zero when the first target engine speed is equal to or lower than an engine speed at a maximum torque point of the engine.

2. The engine control device according to claim 1, wherein the first setting unit is configured to decrease the second target engine speed when the first target engine speed is reduced in a predetermined range.

3. The engine control device according to claim 1, wherein the first setting unit sets the second target engine speed at a predetermined engine speed when the first target engine speed is set at a first engine speed that is equal to or exceeds a second engine speed at which a pump-absorption-torque-characteristic line in the hydraulic pump starts to shift when the first target engine speed is decreased from a rated engine speed.

4. The engine control device according to claim 1, further comprising a torque detector that detects an engine output torque, wherein the second setting unit sets a fourth target engine speed according to the engine output torque, the fourth target engine speed having the first target engine speed as the upper limit and the second target engine speed as the lower limit, and defines a higher one of the fourth target engine speed corresponding to the engine output torque and the third target engine speed corresponding to the pump capacity as a final target engine speed.

5. An engine control device comprising:

a variable displacement hydraulic pump driven by an engine;

a hydraulic actuator driven by a discharge pressure oil from the hydraulic pump;

a control valve that controls the discharge pressure oil from the hydraulic pump so that the discharge pressure oil is supplied to and discharged from the hydraulic actuator;

a pump capacity detector that detects a pump capacity of the hydraulic pump;

a fuel injector that controls a fuel supplied to the engine;

a command unit that selects a set command value among variable command values and commands the set command value;

a first setting means for setting a first target engine speed in response to the set command value commanded by the command unit and a second target engine speed based on the first target engine speed, the second target engine speed being equal to or lower than the first target engine speed;

a second setting means for setting a third target engine speed according to the pump capacity, the third target engine speed having the first target engine speed as an upper limit and the second target engine speed as a lower limit; and a controller that controls the fuel injector so as to provide the third target engine speed set by the second setting means, wherein the first setting means is configured to, based on the first target engine speed being reduced, decrease a reduction range from the first target engine speed to the second target engine speed, and further to either keep the second target engine speed constant or decrease the second target engine speed, and the reduction range is set at zero when the first target engine speed is equal to or lower than an engine speed at a maximum torque point of the engine.

6. The engine control device according to claim 5, wherein the first setting means is configured to decrease the second target engine speed when the first target engine speed is reduced in a predetermined range.

7. The engine control device according to claim 5, wherein the first setting means sets the second target engine speed at a predetermined engine speed when the first target engine speed is set at a first engine speed that is equal to or exceeds a second engine speed at which a pump-absorption-torque-characteristic line in the hydraulic pump starts to shift when the first target engine speed is decreased from a rated engine speed.

8. The engine control device according to claim 5, further comprising a torque detector that detects an engine output torque, wherein the second setting means sets a fourth target engine speed according to the engine output torque, the fourth target engine speed having the first target engine speed as the upper limit and the second target engine speed as the lower limit, and defines a higher one of the fourth target engine speed corresponding to the engine output torque and the third target engine speed corresponding to the pump capacity as a final target engine speed.

* * * * *